US009999914B2

(12) United States Patent
Marcon

(10) Patent No.: US 9,999,914 B2
(45) Date of Patent: Jun. 19, 2018

(54) PUNCH FOR CRIMPING TOOL AND CRIMPING TOOL PROVIDED WITH SUCH A PUNCH

(71) Applicant: ETABLISSEMENTS PIERRE GREHAL ET CIE SA, Baillet-en-France (FR)

(72) Inventor: Lionel Marcon, Parmain (FR)

(73) Assignee: ETABLISSEMENTS PIERRE GREHAL ET CIE SA, Baillet-en-France (FR)

( * ) Notice: Subject to any disclaimer, the term of this patent is extended or adjusted under 35 U.S.C. 154(b) by 0 days. days.

(21) Appl. No.: 15/119,770

(22) PCT Filed: Feb. 12, 2015

(86) PCT No.: PCT/FR2015/050351

§ 371 (c)(1),
(2) Date: Aug. 18, 2016

(87) PCT Pub. No.: WO2015/124849

PCT Pub. Date: Aug. 27, 2015

(65) Prior Publication Data

US 2017/0050231 A1 Feb. 23, 2017

(30) Foreign Application Priority Data

Feb. 19, 2014 (FR) ..... 14 51326

(51) Int. Cl.

| | |
|---|---|
| ***B21D 39/03*** | (2006.01) |
| ***E04F 21/18*** | (2006.01) |
| ***B25B 7/02*** | (2006.01) |
| ***B25B 7/12*** | (2006.01) |

(52) U.S. Cl.

CPC ..... *B21D 39/034* (2013.01); *B21D 39/035* (2013.01); *B25B 7/02* (2013.01); *B25B 7/12* (2013.01); *E04F 21/1855* (2013.01)

(58) Field of Classification Search

CPC .... B21D 39/035; B21D 39/34; B21D 39/034; B25B 7/02; B25B 7/12; B25B 27/146; B25B 27/31; E04F 21/1855

USPC ..... 72/409.01; 29/243.5

See application file for complete search history.

(56) References Cited

U.S. PATENT DOCUMENTS 9,440,279 B2 * 9/2016 Marcon ..... B21D 39/035

FOREIGN PATENT DOCUMENTS

| | | |
|---|---|---|
| DE | 100 54 752 | 5/2002 |
| EP | 0 203 241 | 12/1986 |
| FR | 2 741 830 | 6/1997 |
| FR | 2 969 950 | 7/2012 |

* cited by examiner

*Primary Examiner* — David B Jones
(74) *Attorney, Agent, or Firm* — Clark & Brody

(57) ABSTRACT

The present invention proposes a crimping punch making it possible to obtain a crimping that is resistant to pulling out. To this end, the punch (20) for a crimping tool comprises a fixing part (21) for fixing to the tool and a punching part (22) consisting of a spike (23) connected to the fixing part by two crimping faces (24) that each exhibit a rectilinear primary profile (241), each crimping face also comprising a secondary profile (242), provided with four notches (243) having a radius of between 1 mm and 2.5 mm, preferably between 1.2 mm and 2 mm, advantageously 1.5 mm.

14 Claims, 5 Drawing Sheets

PUNCH FOR CRIMPING TOOL AND CRIMPING TOOL PROVIDED WITH SUCH A PUNCH

Figure 1:
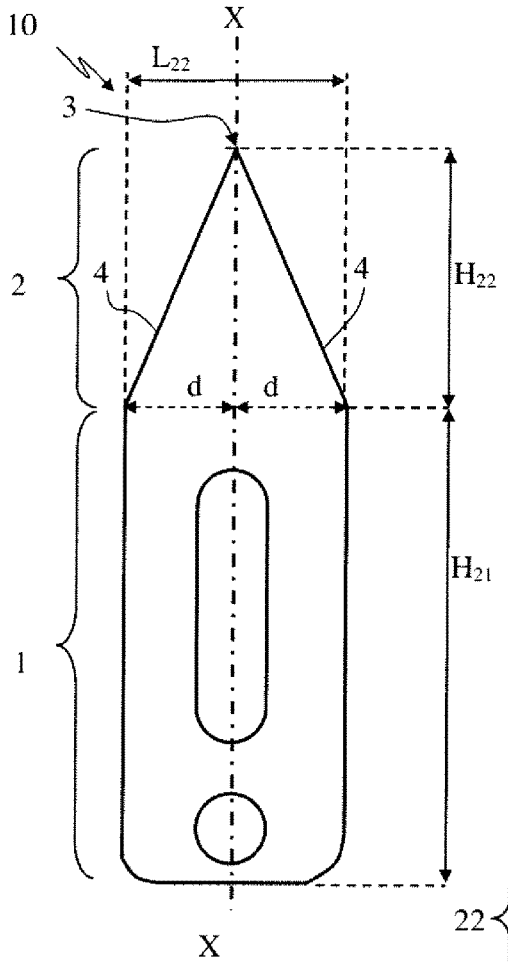

The invention relates to a punch for a crimping tool, such as crimping pliers, for assembling two pieces together by means of crimping. In particular, these pieces are advantageously open metal profile sections arranged one against the other and used, particularly, in certain structures or frameworks for assembling plaster panels on a wall or on a ceiling.

Conventionally, the metal profile sections used have a form with a U-shape cross section.

Generally, these metal profile sections are subject to few shear forces such that crimping suffices to assemble them together. Nevertheless, in the course of certain assembly operations, it may be the case that the crimpings are subject to a great deal of force and pull out one from the other. This is why, generally, use is made of U-shape profile sections imbricated one in the other such that the flanges of each profile section hold the other profile section.

For example, when a false ceiling is installed, U-shape profile sections are fixed at the top and at the periphery of the room such that the web of each profile section is fixed to the wall by solid attachments such as screws or tacks.

In this position, the flanges of each profile section are parallel to one another and parallel to the floor. Next, other U-shape profile sections are inserted between the flanges of two U-shape profile sections fixed to opposite walls. Thus, the second profile sections are perpendicular to the first ones and held by the flanges of the first profile sections.

In order to prevent the second profile sections from moving when the plaster panels are screwed onto them underneath, the profile sections are crimped together using a crimping punch.

The use of U-shape profile sections at the periphery of the room is necessary to hold the second profile sections at a height when the screwing operation imparts an upward force on the second profile sections.

If the crimpings were sufficiently resistant to pulling out, there will be no need to use U-shape profile sections but simply much less expensive brackets.

Other structures or frameworks produced by assembling profile sections require the assembly of rails or uprights back-to-back. This is the case, for example, of uprights designed to support ceilings of a height in excess of 2.50 m. Another example is that of the horizontal rails that have to be mounted back-to-back in order to allow the insertion and the holding of insulating material between two rails and also the subsequent fixing of the plaster panels. In such assembly operations, the solidity of the fixing of the profile sections back-to-back is critical. Document FR2969951 has already proposed crimping pliers specially adapted to fixing U-shape profile sections back-to-back.

The general principle of crimping consists in placing two profile sections to be crimped between two jaws of a crimping tool, one of the jaws being movable relative to the other and carrying the crimping punch.

There are two types of crimping tool.

In the first type, the jaws are mounted pivotably relative to one another such that the punch moves over an arc of a circle during crimping.

In a second type of tool, the punch moves linearly in translation during crimping. To that end, either the punch is fixed on a jaw mounted movably in translation relative to the other jaw or the punch is mounted movably in translation relative to the two spaced-apart jaws mounted fixedly one relative to the other.

The present invention relates to this second type of crimping tool.

Such a tool is provided with a crimping punch consisting of a generally triangular spike, the edges of which are smooth. The necessary pulling-out force obtained by such a punch is approximately 20 DaN, while the force necessary for crimping is approximately 36 DaN.

It has already been proposed to provide each edge of the spike with a tooth.

The latter is obtained by machining the punch, removing material to form two concave notches of determined radius of concavity, for example using a bit or a cutting tool having such a radius. In other words, within the meaning of the present invention, a tooth is arranged between two notches.

The resistance to pulling-out of the crimpings obtained with this type of punch is greater than that obtained with a punch in which the crimping faces (the edges) are straight (primary profile) and smooth (secondary profile), i.e. devoid of teeth. Nevertheless, toothed punches have been used infrequently because the force required for crimping was much greater.

In order to reduce these crimping forces, it has already been proposed to modify the form of the edges by providing rounded excroissances thereon.

Although these excroissances have made it possible to increase the crimping strength, the crimping force, meanwhile, has increased such that these punches are likewise infrequently used.

Document FR2969951 proposes a toothed punch provided with two teeth (three notches). However, if the resistance to pulling-out is slightly increased as compared to a punch provided with a single tooth per crimping face, the force required to implement crimping is much greater than with a single tooth (two notches), such that the user very quickly tires. In order to assist the user, it has been proposed to elongate the handles in order to increase the lever effect. However, this solution is unsatisfactory because the tool becomes very cumbersome.

That is why a number of professionals prefer to use screws in order to fix the profile sections together. This makes it possible to obtain optimum resistance to pulling-out (a pulling-out force of 80 DaN approximately has to be applied in order to separate two profile sections fixed by a screw), while at the same time limiting the forces needed, because the screwing operation generally takes place with the aid of an electric tool. However, the screw interferes with the insertion of insulating material and the risks of injury are significant.

It is thus appropriate to propose a solution that allows fixing of the profile sections together while offering enhanced resistance to pulling-out and at the same time limiting the necessary crimping forces.

One of the objects of the present invention is thus to propose a crimping punch that makes it possible to obtain a crimping that is more resistant to pulling-out than crimpings known hitherto, but with a crimping force that is substantially (at most 10% greater than the crimping force needed with a straight, smooth punch) identical to or even less than the crimping force needed to crimp two profile sections together with a straight, smooth punch.

The applicant became aware that, against all expectations, it is possible to obtain a strong crimping with a limited crimping force by increasing the number of teeth, choosing specific radius values for the notches.

To that end, the subject of the invention is a punch for a crimping tool, comprising a part for fixing to the tool and a punching part consisting of a spike connected to the fixing part by two crimping faces each having a primary rectilinear profile, each crimping face furthermore comprising a secondary profile provided with four notches having a radius of between 1 mm and 2.5 mm, preferably between 1.2 mm and 2 mm, advantageously 1.5 mm.

The primary profile, or order 1 profile, is the mean profile of the crimping face between the spike and the fixing part. According to the invention, this primary profile is rectilinear, i.e. the punching part has a generally triangular form.

The secondary profile is the exact profile of the crimping face between the spike and the fixing part. According to the invention, this secondary profile has four notches that together define three teeth.

According to other embodiments:

- all the notches in the same crimping face may have the same radius;
- the notches in the same crimping face may have different radii;
- each notch may have a depth, taken between the primary profile and a point of the notch furthermost from the primary profile, of between 0.15 mm and 0.33 mm;
- all the notches in the same crimping face may have the same depth;
- the notches in the same crimping face may have different depths; and/or
- the punching part may have a height of between 0.9 cm and 1.5 cm, preferably 1 cm, and a width of between 0.7 cm and 0.9 cm, preferably 0.83 cm.

A further subject of the invention is a crimping tool for crimping two pieces together, comprising two jaws mounted in translation relative to one another, between an open position in order to be positioned on either side of the pieces to be crimped and a closed position at the end of crimping, characterized in that one of the jaws carries a punch according to the invention and the other jaw has a die for receiving the punch when the two jaws are in the closed position.

A further subject of the invention is a crimping tool for crimping two pieces together, comprising a first and a second jaw spaced apart and mounted fixedly relative to one another, characterized in that the first jaw carries a punch according to the invention mounted movably in translation between an open position in which the punch is retracted into the first jaw in order to allow the positioning of the jaws on either side of the pieces to be crimped and a crimping position in which the punch extends from the first jaw as far as the second jaw, the second jaw having a die for receiving the punch when the punch is in the crimping position.

A further subject of the invention is a crimping tool for crimping two pieces together, comprising two jaws mounted pivotably and in translation relative to one another between an open position in order to be positioned on either side of the pieces to be crimped and a closed position, characterized in that one of the jaws carries a punch according to the invention mounted movably in translation between a cleared position in which the punch is retracted into the first jaw and a crimping position in which the punch extends from the first jaw as far as the second jaw, and the second jaw has a die for receiving the punch when the two jaws are in the closed position.

Figure 2:
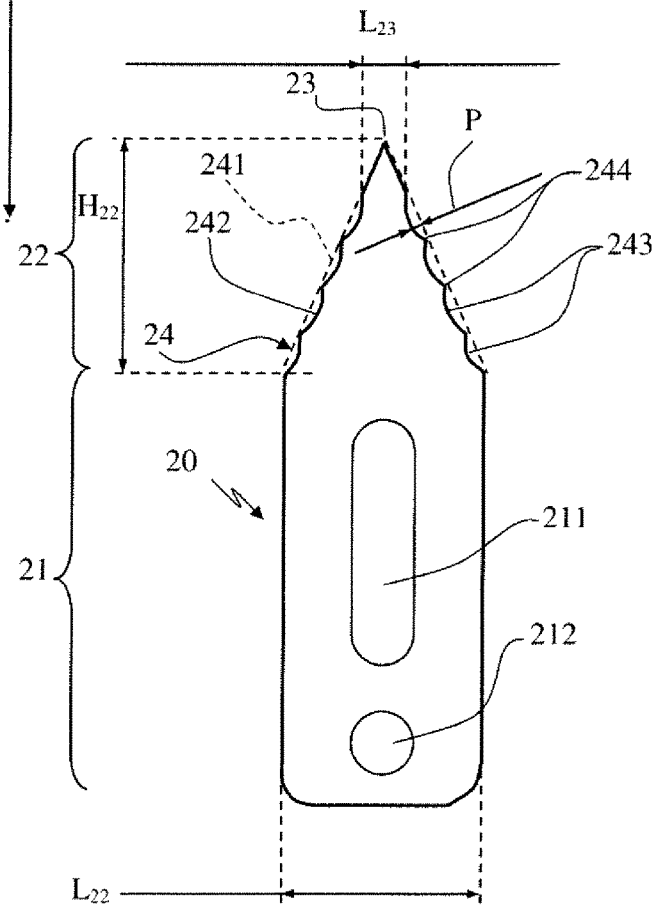
Figure 3:
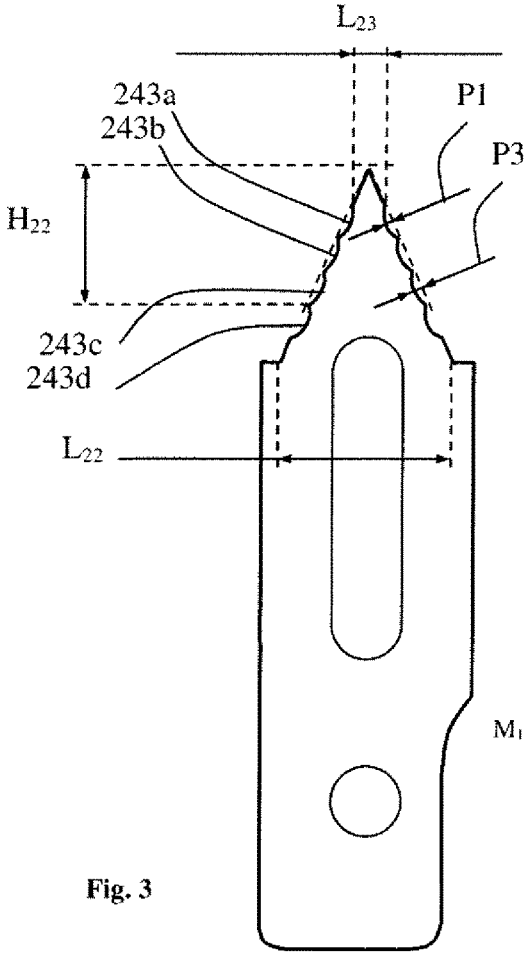
Figure 4:
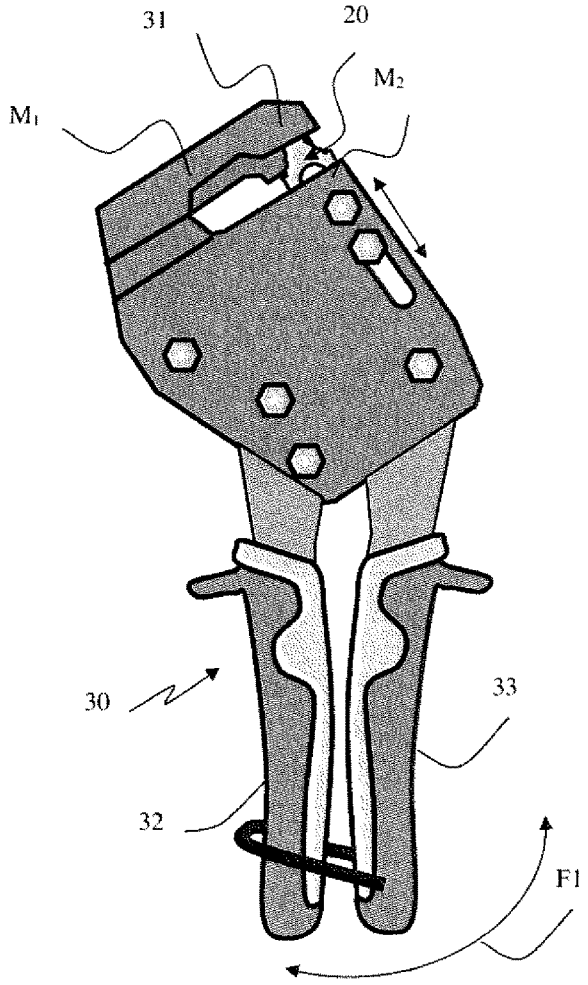
Figure 5:
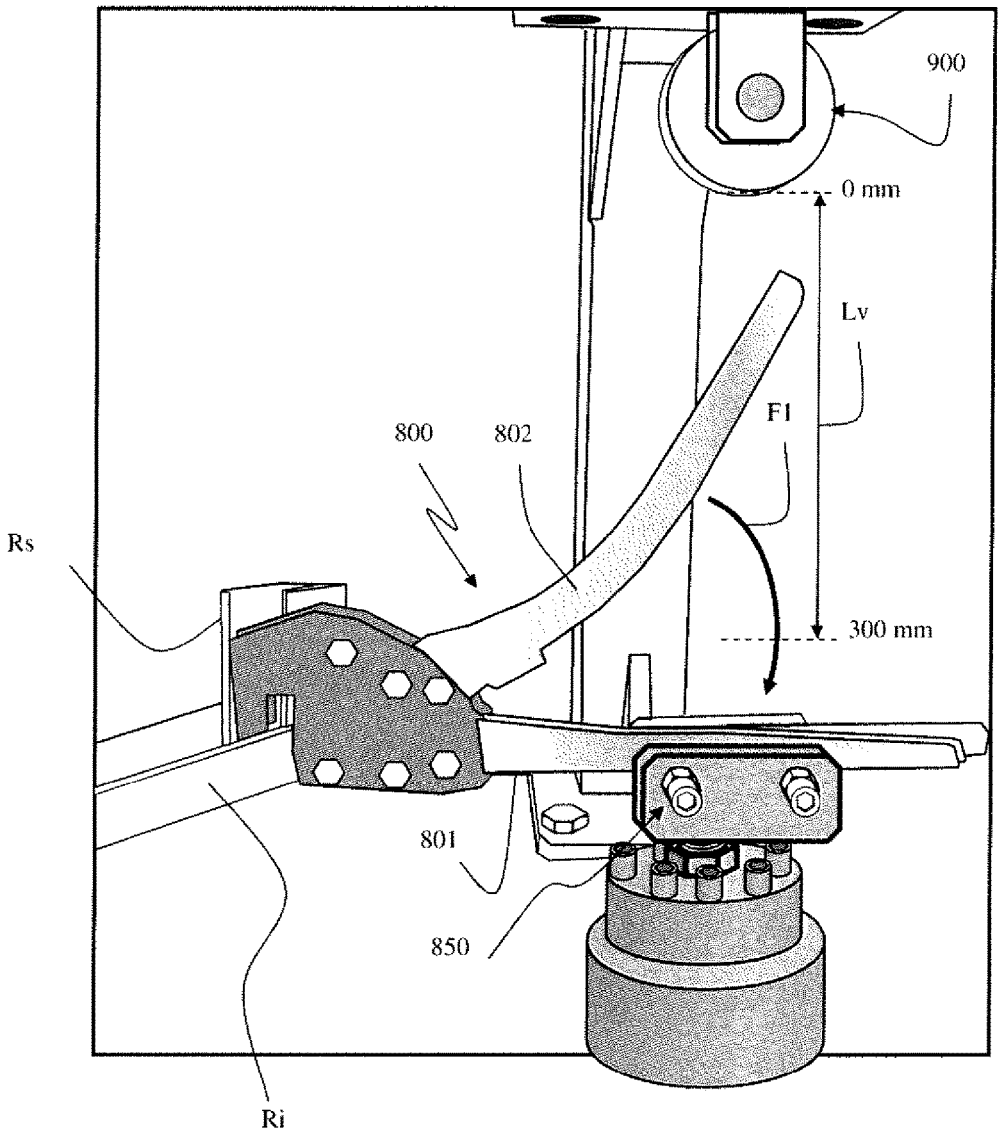
Figure 6:
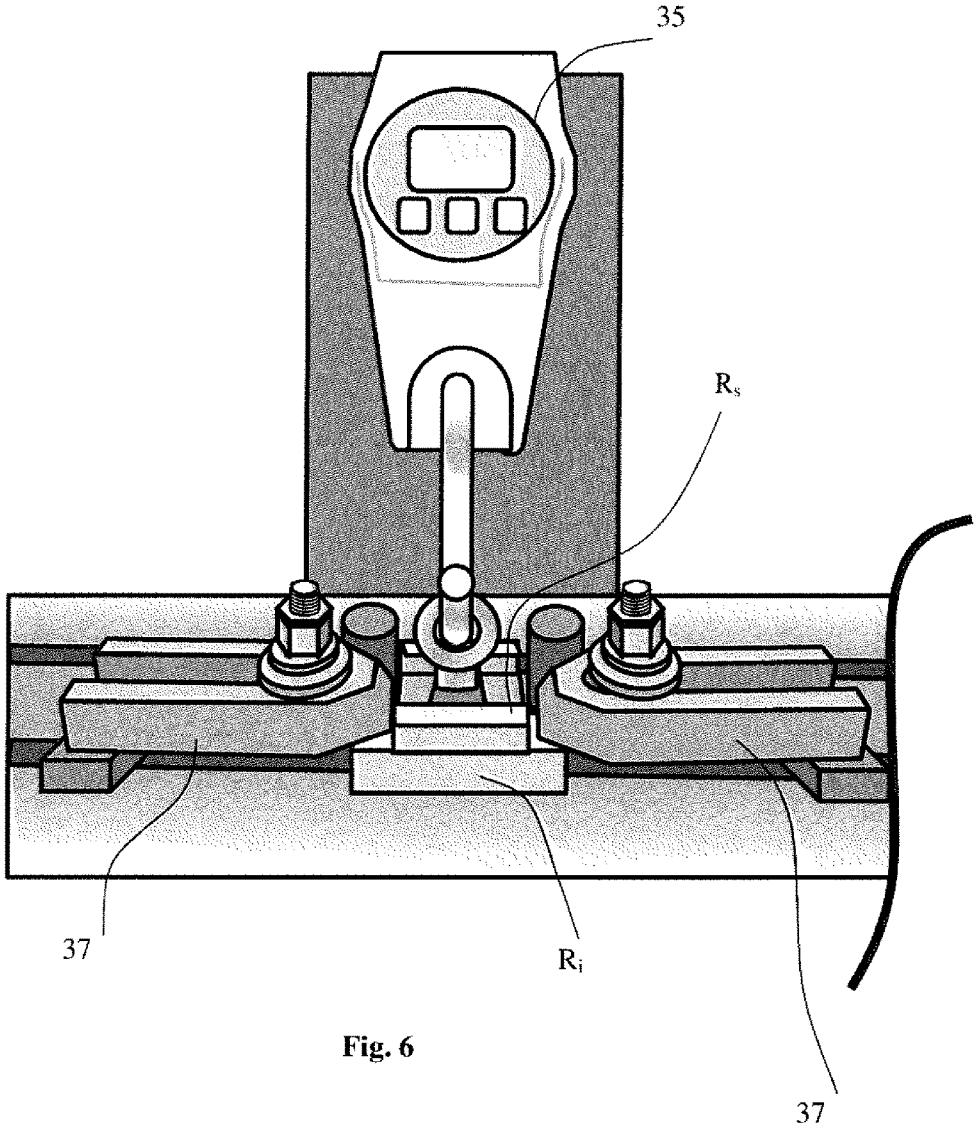
Figure 7:
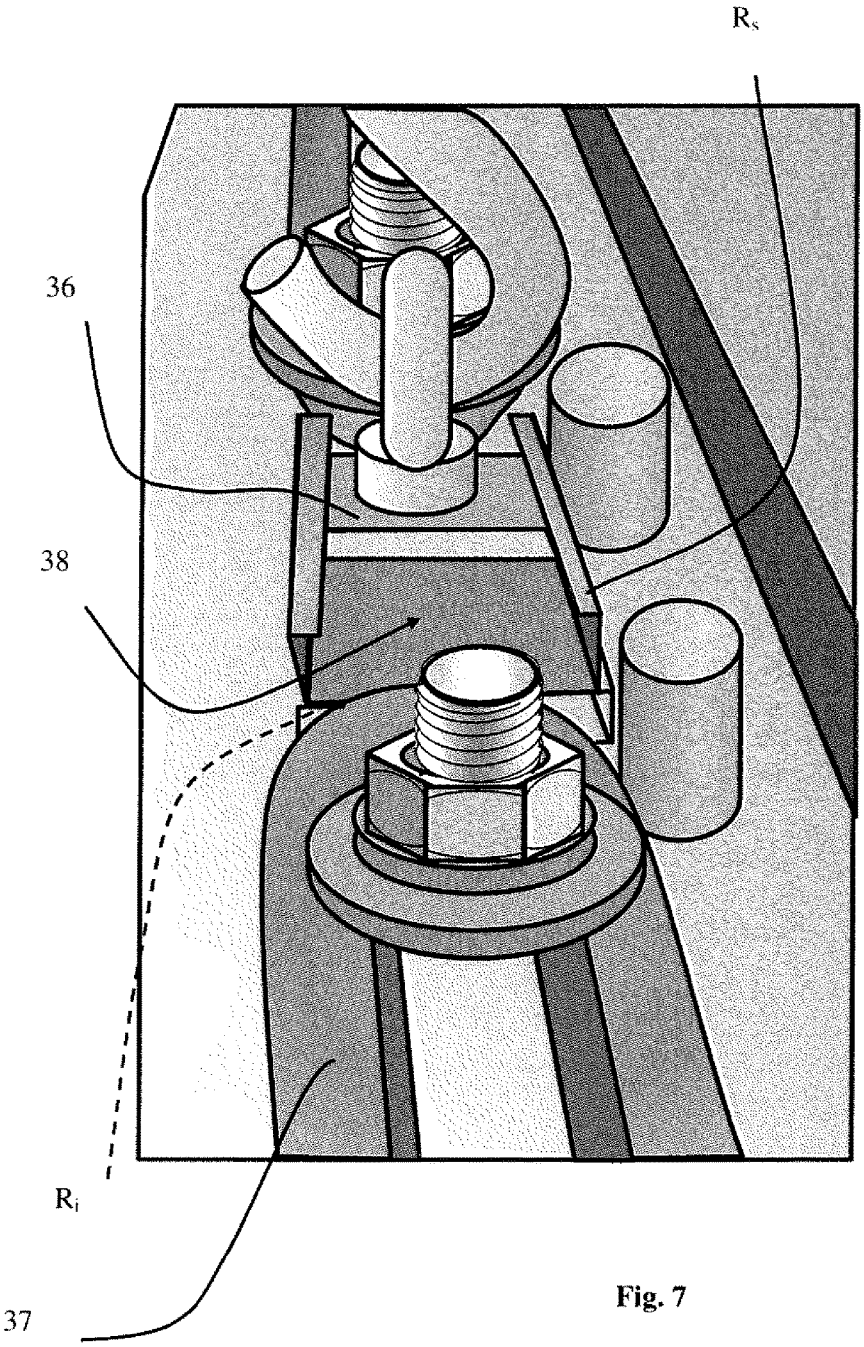

Further features of the invention will be described in the following detailed description given with reference to the appended drawings, which show, respectively:

FIG. 1: a schematic plan view of a prior art punch;

FIG. 2: a schematic plan view of a first embodiment of a punch according to the invention;

FIG. 3: a schematic plan view of a second embodiment of a punch according to the invention, with manufacturing settings;

FIG. 4: a photograph of prior art crimping pliers provided with a punch according to the invention;

FIGS. 5 and 6: photographs, respectively, front-on and in profile, of an assembly for measuring the resistance to pulling-out of crimpings achieved using a punch according to the invention; and FIG. 7: a front-on photograph of an assembly for measuring the force required for crimping implemented with the aid of a punch according to the invention.

As FIG. 1 shows, a prior art punch 10 comprises a part 1 for fixing to a crimping tool (not shown) and a punching part 2 consisting of a spike 3 connected to the fixing part 1 by two crimping faces 4 having a primary rectilinear profile and a secondary smooth profile.

FIG. 2 illustrates a first embodiment of a punch according to the invention. This punch 20 comprises a part 21 for fixing to a crimping tool and a punching part 22 consisting of a spike 23 connected to the fixing part 21 by two crimping faces 24.

According to the invention, each crimping face 24 comprises a primary rectilinear profile 241 and a secondary toothed profile 242. More particularly, the secondary profile comprises four notches 243 defining three teeth 244 between them.

The transition from zero teeth to one tooth and from one tooth to two teeth per crimping face considerably increases the crimping force necessary.

It was found, surprisingly, that the number of three teeth separated by four notches of a radius between 1 mm and 2.5 mm made it possible to increase the resistance to a pulling-out of the crimping while limiting the mean force necessary for crimping.

With a radius of 2.5 mm, the mean crimping force increases by barely 7% as compared to a smooth punch, whereas crimping resistance increases by almost 32%.

Preferably, the radius of the notches is between 1.2 mm and 2 mm.

With a radius of 2.5 mm, the mean crimping force increases by barely 7% as compared to a smooth punch, whereas the crimping resistance increases by almost 132%.

Advantageously, the radius of the notches is between 1 mm and 1.5 mm.

Within this range, the mean crimping force is substantially identical to that of a smooth punch, while crimping resistance increases by almost 140%.

All the notches in the same crimping face may have the same radius. Preferably, the notches in the same crimping face have different radii, it being understood that these radii are within the range of 1 mm to 2.5 mm, preferably 1.2 mm to 2 mm, advantageously 1.5 mm.

The preferred embodiment is a punch comprising, on each crimping face, a first notch of 1 mm radius (first notch 243*a*, starting from the spike) and three notches of 2 mm radius (last three notches 243*b*, 243*c*, and 243*d*). This punch architecture is particularly effective since such a punch has a mean force necessary for crimping that is slightly (−1.6%) less than that of a smooth prior art punch and a pulling-out resistance of 49 DaN, which is more than 150% greater than that obtained with a smooth prior art punch (19.8 DaN).

Likewise, all the notches 243 in the same crimping face may either have the same depth or have different depths.

The depth P is the distance taken between the primary profile 241 and the point of the notch furthest from the primary profile.

Preferably, the depth of the notches of the punch according to the invention is between 0.15 mm and 0.33 mm.

For example, the punch illustrated in FIG. 3 has notches of different depths. The first notch 243*a*, starting from the spike 23, has a depth P1 of 0.176 mm, while the last three notches 243*b*, 243*c*, and 243*d*, starting from the spike 23 have a depth P3 of 0.318 mm.

The first notch 243*a* starting from the spike 23 is advantageously placed on each face 24 such that the spike 23 has a maximum width $L_{23}$, taken between the primary profile and the junction with the first two notches, and is between 2.4 and 2.6 mm.

For example, the punch illustrated in FIG. 3 has a spike width $L_{23}$ of 2.55 mm.

In the embodiment illustrated, the punching part 22 has a height $H_{22}$ of between 0.9 cm and 1.5.

For example, the punch illustrated in FIG. 3 has a height $H_{22}$ of 1 cm approximately.

The punching part 22 likewise has a width $L_{22}$, taken at the level of the junction between the punching part and the fixing part, of between 0.7 cm and 0.9 cm.

For example, the punch illustrated in FIG. 3 has a width $L_{22}$ equal to 8.31 mm approximately.

In the embodiments illustrated, machining has removed the material from the punch such that the apexes of the teeth of the faces 24 are tangential to the virtual rectilinear planes constituted by the primary profiles 241 of the faces 24.

Material is removed in such a manner as to begin cutting the crimping faces in accordance with the concave slots 243 of specific radius of concavity.

According to the invention, a bit of a radius between 1 mm and 2.5 mm, preferably between 1.2 mm and 2 mm, advantageously 1.5 mm, is used to remove the material from the punch.

This removal of material is effected in such a manner that the spike of the teeth is slightly curved in order to allow the rolling of the material during crimping. If the spike of the teeth is too sharp, i.e. If the spike of each tooth is too pointed, there is a risk of cutting away material during crimping, thereby weakening the resistance to pulling-out of the crimping.

Alternately, in embodiments that are not illustrated, the virtual straight planes of the faces 24 intersect the teeth of the crimping faces. The height of the teeth of each crimping face may thus be modulated while preserving a general straight form of said virtual faces 24.

In the two embodiments of FIGS. 2 and 3, the spike 23 is centered relative to the first and second crimping faces. In other words, the longitudinal axis XX of the punch passing through the spike 23 is located at an equal distance d from the crimping faces at the level of the junction between the crimping part 22 and the fixing part 21.

The fixing part 21 comprises two orifices: an oblong orifice 211 for guidance in translation and a circular, fixing orifice 212 for the passage of a screw for fixing to the mechanism for moving the crimping tool in translation.

Such a crimping tool may, for example, be crimping pliers as described in patent FR2741830 and illustrated in FIG. 4.

FIG. 4 illustrates a crimping tool 30 according to the invention for crimping two pieces together. This tool comprises two jaws $M_1$ and $M_2$ fixed relative to one another and spaced apart in order to be able to be positioned on either side of the pieces to be crimped.

One $M_2$ of the jaws carries a punch 20 according to the invention, mounted slidably in translation in the jaw $M_2$ between an open position in which the punch is retracted into the first jaw and a crimping position in which the punch extends from the first jaw as far as the second jaw. The second jaw $M_1$ has a die 31 for receiving the punch when the punch is in the crimping position.

The punch is moved in translation by a knuckle mechanism (not visible in the figure) actuated by the relative movement of the handles 32 and 33 of the tool, in the direction of the arrow F1.

A further subject of the invention is a crimping tool, which is not shown, comprising two jaws mounted pivotably and in translation relative to one another between an open position in order to be positioned on either side of the pieces to be crimped and a closed position in which one of the jaws carries a punch according to the invention, mounted movably in translation between a cleared position in which the punch is retracted into the first jaw and a crimping position in which the punch extends from the first jaw as far as the second jaw, and the second jaw has a die for receiving the punch when the two jaws are in the closed position.

Such a tool is described in document FR2969951, except for the punch according to the invention.

A further subject of the invention is a crimping tool, which is not shown, comprising two jaws mounted in translation relative to one another between an open position in order to be positioned on either side of the pieces to be crimped and a closed position at the end of crimping, in which one of the jaws carries a punch according to the invention and the other jaw has a die for receiving the punch when the two jaws are in the closed position.

The six teeth of the punch according to the invention (three per crimping face 24) allow crimpings that are much more resistant to pulling-out to be obtained.

Tests were performed with:

- E1: a punch with straight, smooth crimping faces, according to FIG. 1;
- E2: a punch with straight crimping faces, each provided with two teeth (three notches), produced using a bit of 2 mm radius;
- E3: a punch with straight crimping faces, each provided with two teeth (three notches), produced with a bit of 2.5 mm radius;
- E4: a punch with straight crimping faces, each provided with two teeth (three notches), produced with a bit of 3 mm radius;
- E5: a punch with straight crimping faces, each provided with three teeth (four notches), produced with a bit of 1 mm radius (for the first notch, starting from the spike) and a bit of 2 mm radius (for the last three notches);
- E6: a punch with straight crimping faces, each provided with three teeth (four notches), produced with a bit of 1.5 mm radius;
- E7: a punch with straight crimping faces, each provided with three teeth (four notches), produced with a bit of 2 mm radius;
- E8: a punch with straight crimping faces, each provided with three teeth (four notches), produced with a bit of 2.5 mm radius;
- E9: a punch with straight crimping faces, each provided with three teeth (four notches), produced with a bit of 3 mm radius.

Thus, as illustrated in FIG. 5, crimping force measurements were performed with the punches E1 to E9 mounted on EDMA® brand "MASTER PROFIL" model pliers 800 for carrying out a single crimping between two profiled STIL® F530 brand rails $R_i$ and $R_s$ in 0.7 mm-thick galvanized steel marketed by PLACO SAINT GOBAIN. One 801 of the handles of the pliers 800 is immobilized in a vice 850 and the other handle 802 is pivoted in the direction of the arrow F1 by a bearing wheel 900 connected to a hydraulic jack (not shown) coupled to a SENSY brand, ref.: 2960-20KN-0.1, serial number 2120127000 force sensor (not shown) with a calibration certificate dated Jul. 9, 2013.

The maximum force (in kilogram force) needed to perform the crimping between the two rails is measured over a jack travel Lv of 300 mm, between a position at 0 mm (shown in FIG. 13), in which the bearing wheel 900 is at a distance from the handle 802 of the pliers 800, and a position 300 mm, in which the handle 802 of the pliers 800 has been fully pivoted by the bearing wheel, corresponding to a maximum penetration of the punch into the rails (crimping position).

Moreover, as illustrated in FIGS. 6 and 7, the pulling-out measurements performed on crimpings made using the punches E1 to E9 involved the assistance of a Kern brand, HCB model dynamometer 35 of version 3.1 dated July 2006.

The experiments consisted in producing a single crimping between two 0.7 mm-thick STIL® F530 brand galvanized steel profiled rails, marketed by PLACO SAINT GOBAIN, then in measuring the maximum force needed to achieve separation of the two rails, i.e. to pull apart the crimping, using the dynamometer 35.

The assembly tested comprises a U-shape upper rail $R_s$ of 70 mm length, 48 mm width and 0.7 mm sheet thickness.

The rail $R_s$ comprises lateral flanges 15 mm high, and lips facing toward the inside of the rail and parallel to the web of the U-shape rail measuring 5 mm. The lips hold the block connected to the dynamometer during measurement.

The U-shape lower rail $R_i$ has a length of 110 mm, a width of 48 mm, a sheet thickness of 0.7 mm and flanges of height 15 mm.

The upper $R_s$ and lower $R_i$ rails are crimped by a single crimping (reference 38 in FIG. 6) centered on the rails, i.e. in the center of the web of the U-shape profile section, equidistant from the flanges.

These rails are conventionally used in the construction of plaster panel walls.

The dynamometer is fixed to the upper rail $R_s$ by a fixing plate 36 immobilized under the lips of the rail, and the lower rail is immobilized on the support by two fixing pieces 37.

The dynamometer is connected to a hydraulic arm (not shown) moving vertically and upward in order to pull apart the two rails.

These tests yielded the following results:

| Test N° | Number of teeth | Number of notches | Radius (in mm) | Mean force necessary for crimping (in DaN) | Force necessary for pulling apart (in DaN) |
|---|---|---|---|---|---|
| E1 | 0 | 0 | 0 | 36.6 | 19.8 |
| E2 | 2 | 3 | 2 | 41.5 | 41 |
| E3 | 2 | 3 | 2.5 | 41.5 | 12 |
| E4 | 2 | 3 | 3 | 41.5 | 17 |
| E5 | 3 | 4 | 1&2 | 36 | 49 |
| E6 | 3 | 4 | 1.5 | 36.6 | 46 |
| E7 | 3 | 4 | 2 | 39 | 46 |
| E8 | 3 | 4 | 2.5 | 39 | 26 |
| E9 | 3 | 4 | 3 | 39 | 20 |

These results confirm that a punch according to the Invention allows an increase in resistance to pulling-apart of between 30 and 150% as compared to a rectilinear, smooth punch, without thereby increasing the mean force necessary for crimping by more than 7%.

With a punch according to E5, E6 or E7, two crimpings suffice to obtain resistance to pulling-out superior to that of a screw.

It is thus possible very solidly to fix profiled sections together with few crimping operations, and without having recourse to screws, using a user-friendly tool that is not cumbersome and avoiding spoiling the insulating material slipped between the profiled sections.

The invention claimed is:

1. A punch (20) for a crimping tool, comprising a part (21) for fixing to the tool and a punching part (22) consisting of a spike (23) connected to the fixing part by two crimping faces (24) each having a primary rectilinear profile (241), each crimping face furthermore comprising a secondary profile (242) provided with four notches (243) having a radius of between 1 mm and 2.5 mm.

2. The punch as claimed in claim 1, wherein the notches (243) in each crimping face have a same radius.

3. The punch as claimed in claim 1, wherein the notches (243) in each crimping face have different radii.

4. The punch as claimed in claim 1, wherein each notch has a depth (P), taken between the primary profile (241) and a point of the notch furthest from the primary profile, the depth being between 0.15 mm and 0.33 mm.

5. The punch as claimed in claim 4, wherein the notches (243) in each crimping face have a same depth.

6. The punch as claimed in claim 4, wherein the notches (243) in each crimping face have different depths.

7. The punch as claimed in claim 1, wherein the punching part (22) has a height ($H_{22}$) of between 0.9 cm and 1.5 cm and a width ($L_{22}$) of between 0.7 cm and 0.9 cm.

8. The punch as claimed in claim 1, wherein the radius is between 1.2 mm and 2 mm.

9. The punch as claimed in claim 8, wherein the radius is 1.5 mm.

10. A crimping tool for crimping two pieces together, comprising two jaws mounted in translation relative to one another, between an open position in order to be positioned on either side of the pieces to be crimped and a closed position at the end of crimping, characterized in that one of the jaws carries a punch as claimed in claim 1 and the other jaw has a die for receiving the punch when the two jaws are in the closed position.

11. The punch as claimed in claim 10, wherein the height ($H_{22}$) is between 1 cm.

12. The punch as claimed in claim 10, wherein the width ($L_{22}$) is 0.83 cm.

13. A crimping tool for crimping two pieces together, comprising a first and a second jaw spaced apart and mounted fixedly relative to one another, characterized in that the first jaw carries a punch as claimed in claim 1 mounted movably in translation between an open position in which the punch is retracted into the first jaw in order to allow the positioning of the jaws on either side of the pieces to be crimped and a crimping position in which the punch extends from the first jaw as far as the second jaw, the second jaw having a die for receiving the punch when the punch is in the crimping position.

14. A crimping tool for crimping two pieces together, comprising two jaws mounted pivotably and in translation relative to one another between an open position in order to be positioned on either side of the pieces to be crimped and a closed position, characterized in that one of the jaws carries a punch as claimed in claim 1 mounted movably in translation between a cleared position in which the punch is retracted into the first jaw and a crimping position in which the punch extends from the first jaw as far as the second jaw, and the second jaw has a die for receiving the punch when the two jaws are in the closed position.

* * * * *